US008193143B2

(12) United States Patent
Lant

(10) Patent No.: US 8,193,143 B2
(45) Date of Patent: Jun. 5, 2012

(54) LAUNDRY DETERGENT COMPOSITION COMPRISING A HIGHLY WATER-SOLUBLE CARBOXYMETHYL CELLULOSE PARTICLE

(75) Inventor: Neil Joseph Lant, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/873,673

(22) Filed: Sep. 1, 2010

(65) Prior Publication Data

US 2011/0034365 A1 Feb. 10, 2011

(30) Foreign Application Priority Data

Sep. 8, 2009 (EP) ..... 09169740

(51) Int. Cl.
*C11D 17/00* (2006.01)

(52) U.S. Cl. ..... 510/438; 510/298; 510/320; 510/349; 510/276; 510/446; 510/510; 510/528; 510/530

(58) Field of Classification Search ..... 510/298, 510/320, 349, 276, 446, 510, 451, 528, 530, 510/438
See application file for complete search history.

(56) References Cited

U.S. PATENT DOCUMENTS 4,865,755 A * 9/1989 Lloyd ..... 510/295
6,362,159 B1 * 3/2002 Aguadisch et al. ..... 512/4
6,593,470 B1 * 7/2003 Bengs et al. ..... 536/123.12
6,600,033 B1 * 7/2003 Lahteenmaki et al. ..... 536/43
6,818,606 B1 * 11/2004 Hanada et al. ..... 510/296
2005/0288206 A1 * 12/2005 Sadlowski et al. ..... 510/392
2006/0183658 A1 * 8/2006 Sadlowski et al. ..... 510/392
2006/0189506 A1 * 8/2006 Muller et al. ..... 510/446
2006/0287211 A1 * 12/2006 Barbizan et al. ..... 510/367
2008/0109968 A1 * 5/2008 Gardiner et al. ..... 8/636
2008/0274182 A1 * 11/2008 Alida Boekema et al. ... 424/480
2008/0287339 A1 * 11/2008 Gould ..... 510/451
2009/0035426 A1 * 2/2009 Verrall et al. ..... 426/291
2009/0318326 A1 * 12/2009 Lant ..... 510/320
2010/0069282 A1 * 3/2010 Prabhat et al. ..... 510/276
2010/0125047 A1 * 5/2010 Lant ..... 510/320

FOREIGN PATENT DOCUMENTS

WO WO2006/087664 A1 8/2006

OTHER PUBLICATIONS

Search Report and Written Opinion from the International Searching Authority, mailed on Oct. 18, 2010, International Application No. PCT/US2010/047460, 12 pages.

* cited by examiner

*Primary Examiner* — Mark Eashoo
*Assistant Examiner* — Jane L Stanley
(74) *Attorney, Agent, or Firm* — Gary J. Foose

(57) ABSTRACT

A solid laundry detergent composition having: (a) detersive surfactant; and (b) from 0.05 wt % to 20 wt % carboxymethyl cellulose particle, wherein the carboxymethyl cellulose particle: (i) from 70 wt % to 98 wt % carboxymethyl cellulose having an average degree of carboxymethyl substitution of from 0.6 to 0.9; (ii) from 2 wt % to 12 wt % water; (iii) optionally from 0 wt % to 4 wt % sodium glycolate; and (iv) optionally from 0 wt % to 4 wt % sodium chloride.

14 Claims, No Drawings

LAUNDRY DETERGENT COMPOSITION COMPRISING A HIGHLY WATER-SOLUBLE CARBOXYMETHYL CELLULOSE PARTICLE

FIELD OF THE INVENTION

The present invention relates to laundry detergent compositions that comprise carboxymethyl cellulose particles. The carboxymethyl cellulose particle exhibit good solubility in water and do not readily gel.

BACKGROUND OF THE INVENTION

Detergent manufacturers incorporate carboxymethyl cellulose and derivatives thereof into their laundry detergent products to improve the soil suspension profile, as well as other benefits such as anti-abrasion. However, with recent trends in the industry towards solid laundry detergents having improved dissolution profiles, and towards the growing consumer trend for washing at colder wash water temperatures, there is a need to improve the dissolution performance of carboxymethyl cellulose and derivatives thereof.

The Inventors have found that whilst small particles of carboxymethyl cellulose exhibit good dissolution, their incorporation into a solid laundry detergent renders the composition very prone to gelling. This in turn, impedes the solubility of the entire laundry detergent composition. Without wishing to be bound by theory, the inventors believe that upon contact with water, the surface of these small carboxymethyl cellulose particles become very sticky. When these small particles are in close proximity with other particles, they are very prone to macromolecular gel formation. Once formed, these macromolecular gels have very poor dissolution profiles. In addition, this surface gelling phenomena also impedes the dissolution of the core of the small particle. However, if the carboxymethyl cellulose particle is too large, then the dissolution performance is very poor.

Furthermore, the inventors have found that pre-hydrating the carboxymethyl cellulose particles with a carefully controlled amount of water reduces the risk of unwanted surface gelling phenomena. The inventors have also found that surface gelling phenomena is impeded by removing, or carefully controlling to very low levels of, electrolytes such as sodium chloride and sodium glycolate.

SUMMARY OF THE INVENTION

The present invention provides a composition as defined by the claims.

DETAILED DESCRIPTION OF THE INVENTION

Solid Laundry Detergent Composition

The solid laundry detergent composition comprises detersive surfactant and carboxymethyl cellulose particle. The solid laundry detergent composition typically comprises other detergent ingredients. The detersive surfactant, carboxymethyl cellulose particle and other detergent ingredients are described in more detail below.

The solid laundry detergent composition typically comprises from 0.05 wt % to 20 wt % carboxymethyl cellulose particle, preferably from 0.1 wt %, or from 0.2 wt %, or from 0.5 wt %, or from 1 wt %, or from 2 wt %, and preferably to 15 wt %, or to 12 wt %, or to 10 wt %, or to 8 wt %, or even to 5 wt % carboxymethyl cellulose particle.

The composition can be any solid form, for example a solid powder or tablet form, or even a detergent sheet. However, it is extremely highly preferred for the composition to be in a free-flowing particulate form, for example such that the composition is in the form of separate discrete particles. Typically, if the composition is in free-flowing particulate form, the composition comprises a plurality of chemically different particles populations.

The composition is a fully formulated laundry detergent composition. The composition is not just a component of a laundry detergent composition that can be incorporated into a laundry detergent composition (such as an enzyme prill, or a surfactant particle, or a bleach particle), it is a fully formulated laundry detergent composition. That said, it is within the scope of the present invention for an additional rinse additive composition (e.g. fabric conditioner or enhancer), or a main wash additive composition (e.g. bleach additive) to also be used in combination with the laundry detergent composition during a laundering process. Although, it may be preferred for no bleach additive composition to be used in combination with the laundry detergent composition during a laundering process.

The composition preferably comprises from 0 wt % to 10 wt % zeolite builder; and from 0 wt % to 10 wt % phosphate builder.

Preferably the composition comprises from 0 wt %, or from 0.1 wt %, or from 0.5 wt %, and preferably to 8 wt %, or to 6 wt %, or to 5 wt %, or to 4 wt %, or to 3 wt %, or even to 2 wt % zeolite builder. The composition may preferably be essentially free from zeolite builder. By: "essentially free from zeolite builder" it is typically meant that the composition comprises no deliberately added zeolite builder. This is especially preferred if it is desirable for the composition to be very highly soluble, to minimise the amount of water-insoluble residues (for example, which may deposit on fabric surfaces), and also when it is highly desirable to have transparent wash liquor. Zeolite builders include zeolite A, zeolite X, zeolite P and zeolite MAP.

The composition preferably comprises from 0 wt % to 8 wt %, or from 0 wt % to 6 wt %, or from 0 wt % to 5 wt %, or from 0 wt % to 4 wt %, or from 0 wt % to 2 wt % phosphate builder. It may even be preferred for the composition to be essentially free from phosphate builder. By: "essentially free from phosphate builder" it is typically meant that the composition comprises no deliberately added phosphate builder. This is especially preferred if it is desirable for the composition to have a very good environmental profile. Phosphate builders include sodium tripolyphosphate.

Without wishing to be bound by theory, when the composition comprises these low levels of, or is free from, zeolite builder and phosphate builder, the wash liquor comprises relatively higher levels of free calcium and magnesium cations. These free cations can interact with the carboxymethyl cellulose, especially the carboxy moiety, and impede the dissolution of the carboxymethyl cellulose. In these low, or no, builder formulations, it is essential that the carboxymethyl cellulose has the required degree of substitution and is pre-hydrated in the manner required by the present invention in order to overcome the solubility problems encountered when elevated levels of free calcium and magnesium cations are present in the wash liquor.

Carboxymethyl Cellulose Particle

The carboxymethyl cellulose particle comprises: (i) from 70 wt % to 98 wt % carboxymethyl cellulose having an average degree of carboxymethyl substitution of from 0.6 to 0.9; (ii) from 2 wt % to 12 wt % water; (iii) optionally from 0 wt % to 4 wt % sodium glycolate; and (iv) optionally from 0 wt % to 4 wt % sodium chloride. Preferably, the particle comprises from 75 wt %, or from 80 wt %, or from 85 wt % carboxymethyl cellulose. Preferably, the particle comprises form 3 wt %, or from 4 wt %, or from 5 wt %, or even from 6 wt % water, and preferably to 10 wt %, or to 8 wt % water.

Preferably, the carboxymethyl cellulose particle has a particle size distribution such that: (a) at least 90 wt % of the particles have a particle size of above 75 micrometers; and (b) less than 15 wt % of particles have a particle size of above 1000 micrometers. Preferably at least 95 wt %, or at least 96 wt %, or at least 97 wt %, or at least 98 wt %, or at least 99 wt % of the particles have a particle size of above 75 micrometers, preferably essentially all of the particles have a particle size of above 75 micrometers. Preferably less than 12 wt %, or less than 10 wt %, or less than 8 wt %, or less than 6 wt %, or less than 4 wt %, or less than 2 wt % of the particles have a particle size of above 1000 micrometers, preferably essentially none of the particles have a particle size of above 1000 micrometers.

Preferably, the carboxymethyl cellulose particle is in non-spray dried form, even more preferably, the carboxymethyl cellulose particle is in agglomerate form.

Carboxymethyl Cellulose

Suitable carboxymethyl cellulose has a structure according to the formula:

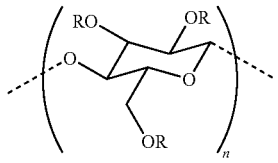

$R_a$= —H
$R_b$= —$CH_2CO_2Na$

Cellulose has three groups (R) available for substitution per repeating unit. For carboxymethyl cellulose, each R group will comprise either $R_a$ or $R_b$ with the 'degree of substitution' being defined as the average number of R groups per repeating cellulose unit that comprise $R_b$. The $R_b$ moiety is the carboxymethyl substituent. The carboxymethyl cellulose has an average degree of carboxymethyl substitution of from 0.6 to 0.9, preferably from 0.7 and preferably to 0.8.

It may be preferred for the carboxymethyl cellulose to be further substituted with a hydrophobic moiety according to the following structure to give a hydrophobically modified carboxymethyl cellulose:

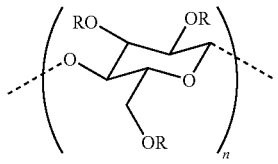

$R_a$ = —H $R_b$ = —$CH_2CO_2Na$ $R_c$ = —C(=O)—CH(R²)—C(=O)—$CH_2$—R¹

$R_d$ = —C(=O)—R¹ wherein, each R group will comprise either $R_a$, $R_b$, $R_c$, or $R_d$ in which $R^1$ and $R^2$ are independently selected from alkyl or alkenyl chains having from 5 to 22 carbon atoms. The $R_b$ moiety is the carboxymethyl substituent. The $R_c$ and $R_d$ moieties are the hydrophobic substituents. The 'degree of carboxymethyl substitution' is defined as the average number of R groups per repeating cellulose unit that comprise $R_b$. The carboxymethyl cellulose has an average degree of carboxymethyl substitution of from 0.6 to 0.9, preferably from 0.7 and preferably to 0.8. The 'degree of hydrophobic moiety substitution' is defined as the average total number of R groups per repeating cellulose unit that comprise $R_c$, and/or $R_d$. Preferably, the average degree of hydrophobic moiety substitution is in the range of from 0.001 to 0.2.

In order to further improve the dissolution performance of the carboxymethyl cellulose, it may be preferred for a combination of smaller molecular weight and larger molecular weight carboxymethyl celluloses to be used, typically in such a manner so that a bimodal molecular weight distribution is achieved. Preferably, the carboxymethyl cellulose has a bimodal molecular weight distribution, wherein the first molecular weight modal has a peak in the range of from 10,000 Da to below 100,000 Da, and wherein the second molecular weight modal has a peak in the range of from 100,000 Da to 300,000 Da. Preferably, the first molecular weight modal has a peak in the range of from 20,000 Da or from 30,000 Da, and preferably to 90,000 Da, or to 80,000 Da, or to 70,000 Da. Preferably, the second second molecular weight modal has a peak in the range of from 120,000 Da, or from 150,000 Da, and preferably to 250,000 Da, or to 200,000 Da.

It may also be preferred for the carboxymethyl cellulose to have a degree of substitution (DS) in the range of from 0.01 to 0.99 and a degree of blockiness (DB) such that the sum of DS+DB is at least 1.00, preferably at least 1.05, or at least 1.10, or at least 1.15, or at least 1.20, or at least 1.25, or at least 1.30, or at least 1.35, or at least 1.40, or at least 1.45, or at least 1.50.

Preferably, the carboxymethyl cellulose has a degree of substitution (DS) in the range of from 0.01 to 0.99 and a degree of blockiness (DB) such that the sum of DB+2DS−$DS^2$ is at least 1.20, or at least 1.25, or at least 1.30, or at least 1.35, or at least 1.40, or at least 1.45, or at least 1.50.

A typical method to determine the degree of substitution (DS) of carboxymethyl cellulose (CMC) is described in more detail below. A typical method to determine the degree of blockiness (DB) of carboxymethyl cellulose (CMC) is described in more detail below.

Detersive Surfactant

The composition comprises detersive surfactant, preferably greater than 1 wt % detersive surfactant, preferably from 10 wt % to 40 wt %, preferably from 12 wt %, or from 15 wt %, or even from 18 wt % detersive surfactant. Preferably, the detersive surfactant comprises alkyl benzene sulphonate and one or more detersive co-surfactants. The detersive surfactant preferably comprises $C_{10}$-$C_{13}$ alkyl benzene sulphonate and one or more detersive co-surfactants. The detersive co-surfactants preferably are selected from the group consisting of $C_{12}$-$C_{18}$ alkyl ethoxylated alcohols, preferably having an average degree of ethoxylation of from 1 to 7; $C_{12}$-$C_{18}$ alkyl ethoxylated sulphates, preferably having an average degree of ethoxylation of from 1 to 5; and mixtures thereof. However, other detersive surfactant systems may be suitable for use in the present invention.

Suitable detersive surfactants include anionic detersive surfactants, nonionic detersive surfactants, cationic detersive surfactants, zwitterionic detersive surfactants, amphoteric detersive surfactants and mixtures thereof.

Suitable anionic detersive surfactants include: alkyl sulphates; alkyl sulphonates; alkyl phosphates; alkyl phosphonates; alkyl carboxylates; and mixtures thereof. The anionic detersive surfactant can be selected from the group consisting of: $C_{10}$-$C_{18}$ alkyl benzene sulphonates (LAS) preferably $C_{10}$-$C_{13}$ alkyl benzene sulphonates; $C_{10}$-$C_{20}$ primary, branched chain, linear-chain and random-chain alkyl sulphates (AS), typically having the following formula:

$$CH_3(CH_2)_xCH_2—OSO_3^-M^+$$

wherein, M is hydrogen or a cation which provides charge neutrality, preferred cations are sodium and ammonium cations, wherein x is an integer of at least 7, preferably at least 9; $C_{10}$-$C_{18}$ secondary (2,3) alkyl sulphates, typically having the following formulae:

$$CH_3(CH_2)_x(\overset{\overset{\displaystyle OSO_3^-M^+}{|}}{C}H)CH_3 \quad \text{or} \quad CH_3(CH_2)_y(\overset{\overset{\displaystyle OSO_3^-M^+}{|}}{C}H)CH_2CH_3$$

wherein, M is hydrogen or a cation which provides charge neutrality, preferred cations include sodium and ammonium cations, wherein x is an integer of at least 7, preferably at least 9, y is an integer of at least 8, preferably at least 9; $C_{10}$-$C_{18}$ alkyl alkoxy carboxylates; mid-chain branched alkyl sulphates as described in more detail in U.S. Pat. No. 6,020,303 and U.S. Pat. No. 6,060,443; modified alkylbenzene sulphonate (MLAS) as described in more detail in WO 99/05243, WO 99/05242, WO 99/05244, WO 99/05082, WO 99/05084, WO 99/05241, WO 99/07656, WO 00/23549, and WO 00/23548; methyl ester sulphonate (MES); alpha-olefin sulphonate (AOS) and mixtures thereof.

Preferred anionic detersive surfactants include: linear or branched, substituted or unsubstituted alkyl benzene sulphonate detersive surfactants, preferably linear $C_8$-$C_{18}$ alkyl benzene sulphonate detersive surfactants; linear or branched, substituted or unsubstituted alkyl benzene sulphate detersive surfactants; linear or branched, substituted or unsubstituted alkyl sulphate detersive surfactants, including linear $C_8$-$C_{18}$ alkyl sulphate detersive surfactants, $C_1$-$C_3$ alkyl branched $C_8$-$C_{18}$ alkyl sulphate detersive surfactants, linear or branched alkoxylated $C_8$-$C_{18}$ alkyl sulphate detersive surfactants and mixtures thereof; linear or branched, substituted or unsubstituted alkyl sulphonate detersive surfactants; and mixtures thereof.

Preferred alkoxylated alkyl sulphate detersive surfactants are linear or branched, substituted or unsubstituted $C_{8-18}$ alkyl alkoxylated sulphate detersive surfactants having an average degree of alkoxylation of from 1 to 30, preferably from 1 to 10. Preferably, the alkoxylated alkyl sulphate detersive surfactant is a linear or branched, substituted or unsubstituted $C_{8-18}$ alkyl ethoxylated sulphate having an average degree of ethoxylation of from 1 to 10. Most preferably, the alkoxylated alkyl sulphate detersive surfactant is a linear unsubstituted $C_{8-18}$ alkyl ethoxylated sulphate having an average degree of ethoxylation of from 1 to 7. Preferably, the laundry detergent composition comprises an alkyl ethoxylated sulphate having an average degree of ethoxylation of from 0.5 to 3.5, preferably from 1.0 to 3.0, and preferably 1.0 or 3.0.

Preferred anionic detersive surfactants are selected from the group consisting of: linear or branched, substituted or unsubstituted, $C_{12-18}$ alkyl sulphates; linear or branched, substituted or unsubstituted, $C_{10-13}$ alkylbenzene sulphonates, preferably linear $C_{10-13}$ alkylbenzene sulphonates; and mixtures thereof. Highly preferred are linear $C_{10-13}$ alkylbenzene sulphonates. Highly preferred are linear $C_{10-13}$ alkylbenzene sulphonates that are obtainable, preferably obtained, by sulphonating commercially available linear alkyl benzenes (LAB); suitable LAB include low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable. Preferably, the laundry detergent composition comprises a predominantly $C_{12}$ alkyl sulphate.

Suitable cationic detersive surfactants include: alkyl pyridinium compounds; alkyl quaternary ammonium compounds; alkyl quaternary phosphonium compounds; alkyl ternary sulphonium compounds; and mixtures thereof. The cationic detersive surfactant can be selected from the group consisting of: alkoxylate quaternary ammonium (AQA) surfactants as described in more detail in U.S. Pat. No. 6,136,769; dimethyl hydroxyethyl quaternary ammonium as described in more detail in U.S. Pat. No. 6,004,922; polyamine cationic surfactants as described in more detail in WO 98/35002, WO 98/35003, WO 98/35004, WO 98/35005, and WO 98/35006; cationic ester surfactants as described in more detail in U.S. Pat. No. 4,228,042, U.S. Pat. No. 4,239,660, U.S. Pat. No. 4,260,529 and U.S. Pat. No. 6,022,844; amino surfactants as described in more detail in U.S. Pat. No. 6,221,825 and WO 00/47708, specifically amido propyldimethyl amine; and mixtures thereof. Preferred cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, preferred anions include halides (such as chloride), sulphate and sulphonate. Preferred cationic detersive surfactants are mono-$C_{6-18}$ alkyl mono-hydroxyethyl di-methyl quaternary ammonium chlorides. Highly preferred cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Suitable non-ionic detersive surfactant can be selected from the group consisting of: $C_8$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, BAEx, wherein x=from 1 to 30, as described in more detail in U.S. Pat. No. 6,153,577, U.S. Pat. No. 6,020,303 and U.S. Pat. No. 6,093,856; alkylpolysaccharides as described in more detail in U.S. Pat. No. 4,565,647, specifically alkylpolyglycosides as described in more detail in U.S. Pat. No. 4,483,780 and U.S. Pat. No. 4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

The non-ionic detersive surfactant could be an alkyl polyglucoside and/or an alkyl alkoxylated alcohol. Preferably the non-ionic detersive surfactant is a linear or branched, substituted or unsubstituted $C_{8-18}$ alkyl ethoxylated alcohol having an average degree of ethoxylation of from 1 to 10, more preferably from 3 to 7.

Fabric Hueing Dye

Preferably, the fabric hueing dye is cotton-substantive. The method for determining whether a pigment or dye is cotton-substantive is described in more detail below. Suitable fabric hueing dyes include small molecule dyes and polymeric dyes. Suitable small molecule dyes include small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof, for example:

(1) Tris-Azo Direct Blue Dyes of the Formula

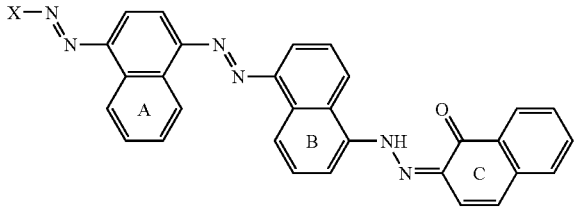

where at least two of the A, B and C napthyl rings are substituted by a sulfonate group, the C ring may be substituted at the 5 position by an $NH_2$ or NHPh group, X is a benzyl or naphthyl ring substituted with up to 2 sulfonate groups and may be substituted at the 2 position with an OH group and may also be substituted with an $NH_2$ or NHPh group.

(2) Bis-Azo Direct Violet Dyes of the Formula:

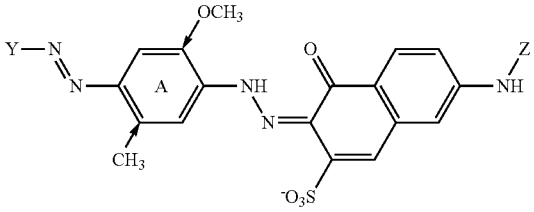

where Z is H or phenyl, the A ring is preferably substituted by a methyl and methoxy group at the positions indicated by arrows, the A ring may also be a naphthyl ring, the Y group is a benzyl or naphthyl ring, which is substituted by sulfate group and may be mono or disubstituted by methyl groups.

(3) Blue or Red Acid Dyes of the Formula

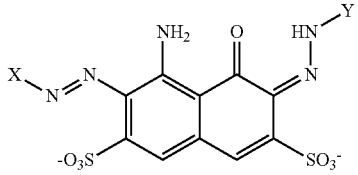

where at least one of X and Y must be an aromatic group. In one aspect, both the aromatic groups may be a substituted benzyl or naphthyl group, which may be substituted with non water-solubilising groups such as alkyl or alkyloxy or aryloxy groups, X and Y may not be substituted with water solubilising groups such as sulfonates or carboxylates. In another aspect, X is a nitro substituted benzyl group and Y is a benzyl group (4) Red Acid Dyes of the Structure

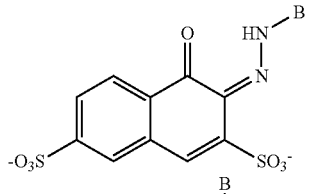

or

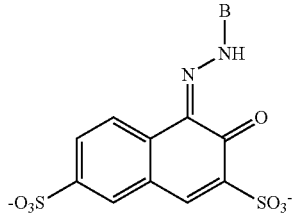

where B is a naphthyl or benzyl group that may be substituted with non water solubilising groups such as alkyl or alkyloxy or aryloxy groups, B may not be substituted with water solubilising groups such as sulfonates or carboxylates.

(5) Dis-Azo Dyes of the Structure

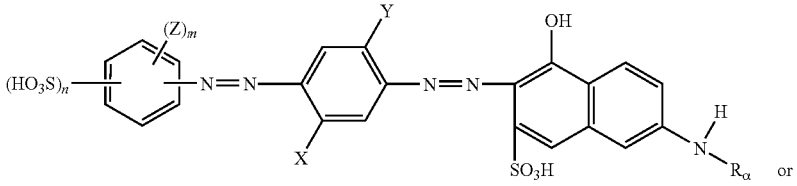

or

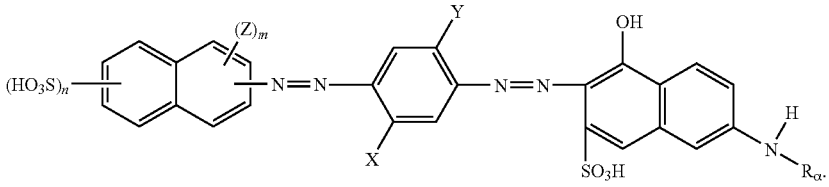

wherein X and Y, independently of one another, are each hydrogen, $C_1$-$C_4$ alkyl or $C_1$-$C_4$-alkoxy, Rα is hydrogen or aryl, Z is $C_1$-$C_4$ alkyl; $C_1$-$C_4$-alkoxy; halogen; hydroxyl or carboxyl, n is 1 or 2 and m is 0, 1 or 2, as well as corresponding salts thereof and mixtures thereof
(6) Triphenylmethane Dyes of the Following Structures
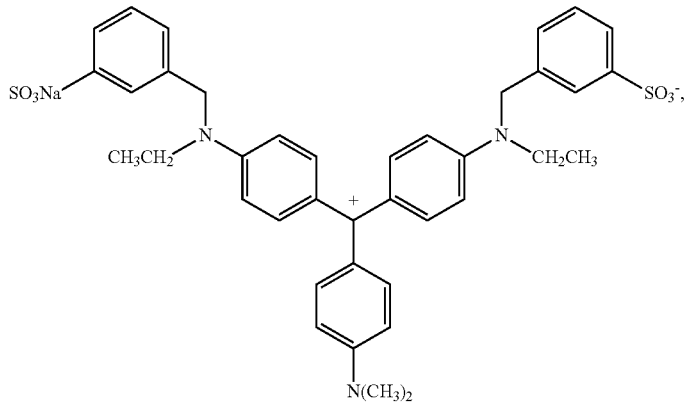
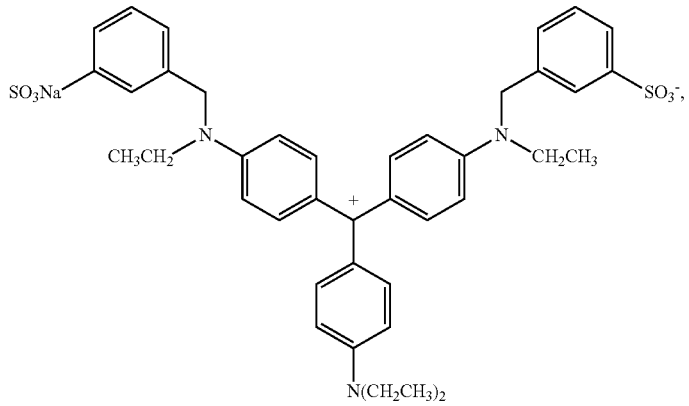
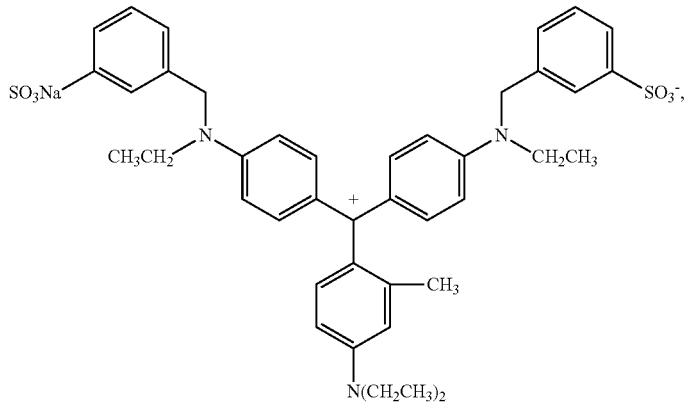

-continued

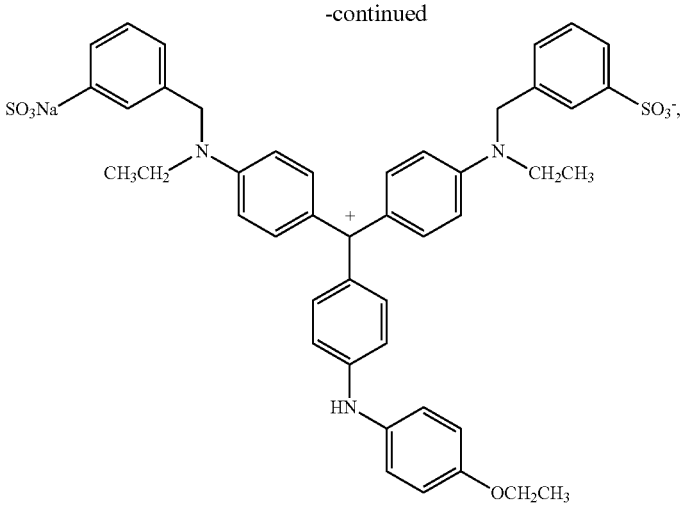

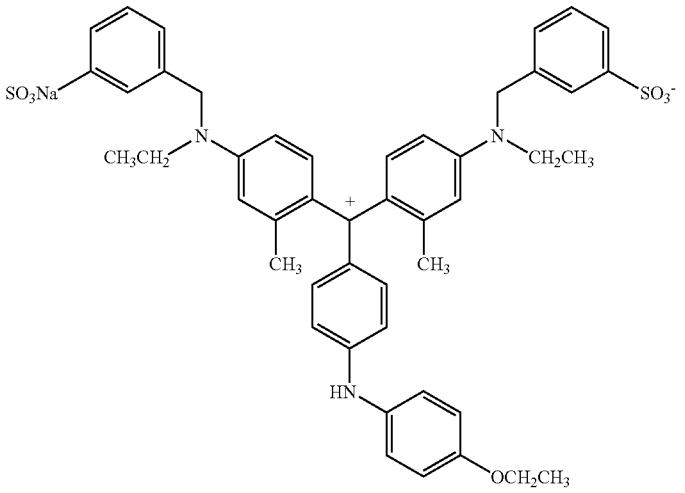

and/or

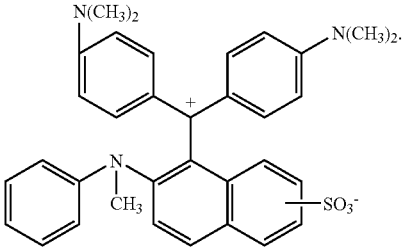

and mixtures thereof. In another aspect, suitable small molecule dyes include small molecule dyes selected from the group consisting of Colour Index (Society of Dyers and Colourists, Bradford, UK) numbers Direct Violet 9, Direct Violet 35, Direct Violet 48, Direct Violet 51, Direct Violet 66, Direct Blue 1, Direct Blue 71, Direct Blue 80, Direct Blue 279, Acid Red 17, Acid Red 73, Acid Red 88, Acid Red 150, Acid Violet 15, Acid Violet 17, Acid Violet 24, Acid Violet 43, Acid Red 52, Acid Violet 49, Acid Blue 15, Acid Blue 17, Acid Blue 25, Acid Blue 29, Acid Blue 40, Acid Blue 45, Acid Blue 75, Acid Blue 80, Acid Blue 83, Acid Blue 90 and Acid Blue 113, Acid Black 1, Basic Violet 1, Basic Violet 3, Basic Violet 4, Basic Violet 10, Basic Violet 35, Basic Blue 3, Basic Blue 16, Basic Blue 22, Basic Blue 47, Basic Blue 66, Basic Blue 75, Basic Blue 159 and mixtures thereof. In another aspect, suitable small molecule dyes include small molecule dyes selected from the group consisting of Colour Index (Society of Dyers and Colourists, Bradford, UK) numbers Acid Violet 17, Acid Violet 43, Acid Red 52, Acid Red 73, Acid Red 88, Acid Red 150, Acid Blue 25, Acid Blue 29, Acid Blue 45, Acid Blue 113, Acid Black 1, Direct Blue 1, Direct Blue 71, Direct Violet 51 and mixtures thereof. In another aspect, suitable small molecule dyes include small molecule dyes selected from the group consisting of Colour Index (Society of Dyers and Colourists, Bradford, UK) numbers Acid Violet 17, Direct Blue 71, Direct Violet 51, Direct Blue 1, Acid Red 88, Acid Red 150, Acid Blue 29, Acid Blue 113 or mixtures thereof.

Suitable polymeric dyes include polymeric dyes selected from the group consisting of polymers containing conjugated chromogens (dye-polymer conjugates) and polymers with chromogens co-polymerized into the backbone of the polymer and mixtures thereof.

In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® (Milliken, Spartanburg, S.C., USA) Violet CT, carboxymethyl cellulose (CMC) conjugated with a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenyl-methane polymeric colourants, alkoxylated thiophene polymeric colourants, and mixtures thereof.

Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by C1-C3-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof. In another aspect, suitable pigments include pigments selected from the group consisting of Ultramarine Blue (C.I. Pigment Blue 29), Ultramarine Violet (C.I. Pigment Violet 15) and mixtures thereof.

The aforementioned fabric hueing dyes can be used in combination (any mixture of fabric hueing dyes can be used). Suitable fabric hueing dyes can be purchased from Aldrich, Milwaukee, Wis., USA; Ciba Specialty Chemicals, Basel, Switzerland; BASF, Ludwigshafen, Germany; Dayglo Color Corporation, Mumbai, India; Organic Dyestuffs Corp., East Providence, R.I., USA; Dystar, Frankfurt, Germany; Lanxess, Leverkusen, Germany; Megazyme, Wicklow, Ireland; Clariant, Muttenz, Switzerland; Avecia, Manchester, UK and/or made in accordance with the examples contained herein.

Suitable fabric hueing dyes are described in more detail in U.S. Pat. No. 7,208,459.

Other Detergent Ingredients

The composition typically comprises other detergent ingredients. Suitable detergent ingredients include: sources of hydrogen peroxide, including percarbonate and perborate salts, especially coated hydrogen peroxide sources; bleach boosters including isoquinolinium and oxaziridinium based bleach boosters; transition metal bleach catalysts including manganese, iron and cobalt bases transition metal bleach catalysts; photobleach; brighteners; alkalinity sources including salts, especially sodium salts, of carbonate, bicarbonate; citric acid or salt thereof; enzymes such as amylases, carbohydrases, cellulases, laccases, lipases, bleaching enzymes such as oxidases and peroxidases, proteases, pectate lyases and mannanases; soil dispersants and soil anti-redeposition aids such as alkoxylated polyamines and ethoxylated ethyleneimine polymers; anti-redeposition components such as polyesters including co-polyesters of di-carboxylic acids and diols; amphilic graft co-polymer, preferably the amphilic graft co-polymer comprises (i) polyethyelene glycol backbone; and (ii) and at least one pendant moiety selected from polyvinyl acetate, polyvinyl alcohol and mixtures thereof, a preferred amphilic graft co-polymer is Sokalan HP22, supplied from BASF; carboxylate polymers, including co-polymers of maleic and acrylic acid; other cellulosic polymers such as methyl cellulose, hydroxyethoxycellulose, or other alkyl or alkylalkoxy cellulose; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as oligomers produced by the condensation of imidazole and epichlorhydrin; perfumes such as perfume microcapsules; soap rings; aesthetic particles; dyes; suds suppressing systems such as silicone based suds suppressors; fabric; fillers such as sodium sulphate, although it may be preferred for the composition to be substantially free of fillers; silicate salt such as sodium silicate, including 1.6 R and 2.0 R sodium silicate, or sodium metasilicate; and any combination thereof.

Synthesis of the Carboxymethyl Cellulose

Methods of producing carboxymethyl cellulose are well described in the art and have been disclosed, for example in T. G. Majewicz and T. J. Podlas, Kirk-Othmer's Encyclopedia of Chemical Technology, $4^{th}$ edition, Chapter 'Cellulose Ethers', Volume 5, pp. 445-465. Methods for controlling 'blockiness' are disclosed in V. Stigsson et al., Cellulose, 2006, 13, pp. 705-712.

Various methods of producing hydrophobically modified carboxymethyl cellulose are disclosed in EP998498 (C. P. Kelco); I. Sroková, V. Tomanová, A. Ebringerová, A. Malovíková, and T. Heinze, Macromolecular Materials and Engineering, 2004, 289 (1), pp. 63-69; and I. Sroková, P. Talába, P. Hodul, and A. Balázová, Tenside, Surfactants, Detergents, 1998, 35 (5), pp. 342-344.

Method to Determine Degree of Carboxymethyl Substitution (DS) of a Carboxymethyl Cellulose (CMC)

The DS was determined by igniting CMC to ash at high temperature (650° C.) for 45 minutes in order to remove all the organic material. The remaining inorganic ashes were dissolved in distilled water and methyl red added. The sample was titrated with 0.1M hydrochloric acid until the solution turned pink. The DS was calculated from the amount of titrated acid (b ml) and the amount of CMC (G g) using the formula below.

$$DS=0.162*\{(0.1*b/G)/[1-(0.08*0.1*(b/G)]\}$$

Alternatively, the DS of a substituted cellulose may be measured by conductimetry or $^{13}C$ NMR. Experimental protocols for both approaches are given in D. Capitani et al, Carbohydrate Polymers, 2000, v 42, pp 283-286.

Method to Determine Degree of Blockiness (DB) of a Carboxymethyl Cellulose (CMC)

In the case of a substituted cellulose, the DB may correspond to the amount (A) of non-substituted glucose units released after a specific enzymatic hydrolysis with the commercial endoglucanase enzyme (Econase CE, AB Enzymes, Darmstadt, Germany) divided by the total amount of non-substituted glucose units released after acid hydrolysis (A+B). The enzymatic activity is specific to non-substituted glucose units in the polymer chain that are directly bounded to another non-substituted glucose unit. Further explanation of substituted cellulose blockiness and measurement is provided in detail in V. Stigsson et al., Cellulose, 2006, 13, pp 705-712.

The enzymatic degradation is performed using the enzyme (Econase CE) in a buffer at pH 4.8 at 50° C. for 3 days. To 25 ml of substituted cellulose sample, 250 μL of enzyme is used. The degradation is stopped by heating the samples to 90° C. and keeping them hot for 15 minutes. The acid hydrolysis for both substitution pattern and blockiness is carried out in perchloric acid (15 min in 70% HClO4 at room temperature and 3 hours in 6.4% HClO4 at 120° C.). The samples are analysed using Anion Exchange Chromatography with Pulsed Amperiometric Detection (PAD detector: BioLC50 (Dionex, Sunnyvale, Calif., USA)). The HPAEC/PAD system is calibrated with $^{13}C$ NMR. The monosaccharides are separated at 35° C. using a flow rate of 0.2 ml/min on a PA-1 analytical column using 100 mM NaOH as eluent with increasing sodium acetate (from 0 to 1M sodium acetate in 30 mins). Each sample is analysed three to five times and an average is calculated. The number of unsubstituted glucose that were directly linked to at least one substituted glucose (A), and the number of unsubstituted glucose that were not directly linked to a substituted glucose (B) are deduced and the DB of the substituted cellulose sample is calculated: DB=B/(A+B).

Method to Determine Degree of Hydrophobic Moiety Substitution of a Hydrophobically Modified Carboxymethyl Cellulose (CMC)

The degree of hydrophobically moiety substitution is determined using FT-IR spectroscopy as described in I. Sroková, V. Tomanová, A. Ebringerová, A. Malovíková, and T. Heinze, Macromolecular Materials and Engineering, 2004, 289 (1), pp. 63-69; and I. Sroková, P. Talába, P. Hodul, and A. Balázová, Tenside, Surfactants, Detergents, 1998, 35 (5), pp. 342-344.

Method for Determining the Cotton-Substantive Profile of a Dye and/or Pigment

A protocol to define whether a dye or pigment material is a cotton-substantive for the purpose of the invention is given here:

1.) Fill two tergotometer pots with 800 ml of water having a hardness of 61.9 mg/L $Ca^{2+}$and 12.5 mg/L $Mg^{2+}$ (~12 grains per US gallon total hardness), e.g. use Newcastle upon Tyne, UK, City Water supplied by Northumbrian Water, Pity Me, Durham, Co. Durham, UK, or add 338.4 mg/L $CaCl2.6H_20$ and 104.6 mg/L $MgCl2.6H_20$ to deionized water 2) Insert pots into tergotometer, with water temperature controlled at 30° C. and agitation set at 40 rpm for the duration of the experiment 3) Add 4.8 g of IEC-B detergent (IEC 60456 Washing Machine Reference Base Detergent Type B), supplied by wfk, Brüggen-Bracht, Germany, to each pot.

4) After two minutes, add 2.0 mg active colorant to the first pot.

5) After one minute, add 50 g of flat cotton vest (supplied by Warwick Equest, Consett, County Durham, UK), cut into 5 cm×5 cm swatches, to each pot.

6) After 10 minutes, drain the pots and re-fill with cold (e.g. 16° C.) water having a hardness of 61.9 mg/L $Ca^{2+}$ and 12.5 mg/L $Mg^{2+}$ (~12 grains per US gallon total hardness).

7) After 2 minutes rinsing, remove fabrics

8) Repeat steps 3-7 for a further three cycles using the same treatments

9) Collect and line dry the fabrics indoors for 12 hours

10) Analyse the swatches using a Hunter Miniscan spectrometer fitted with D65 illuminant and UVA cutting filter, to obtain Hunter a (red-green axis) and Hunter b (yellow-blue axis) values.

11) Average the Hunter a and Hunter b values for each set of fabrics. If the fabrics treated with colorant under assessment show an average difference in hue of greater than 0.2 units on either the a axis or b axis, it is deemed to be a cotton-substantive hueing dye for the purpose of the invention.

EXAMPLES

The following are granular detergent compositions produced in accordance with the invention suitable for laundering fabrics by handwashing or top-loading washing machines.

| | Compositions | | | | | |
|---|---|---|---|---|---|---|
| | 1 (wt %) | 2 (wt %) | 3 (wt %) | 4 (wt %) | 5 (wt %) | 6 (wt %) |
| Linear alkylbenzenesulfonate | 20 | 12 | 20 | 10 | 12 | 13 |
| Other detersive surfactants | 1.6 | 1.2 | 1.9 | 3.2 | 0.5 | 1.2 |
| Phosphate builder(s) | 5 | 25 | 4 | 3 | 2 | — |
| Zeolite | — | 1 | — | 1 | 4 | 1 |
| Silicate 1.6R | 4 | 5 | 2 | 3 | 3 | 5 |
| Sodium Carbonate | 9 | 20 | 10 | 17 | 5 | 23 |

-continued

| | Compositions | | | | | |
|---|---|---|---|---|---|---|
| | 1 (wt %) | 2 (wt %) | 3 (wt %) | 4 (wt %) | 5 (wt %) | 6 (wt %) |
| Polyacrylate (MW 4500) | 1 | 0.6 | 1 | 1 | 1.5 | 1 |
| Highly soluble carboxymethyl cellulose particle[1] | 1 | 0.3 | 0.3 | 0.1 | 1.1 | 0.9 |
| Cellulase[2] | 0.1 | — | 0.1 | | 0.3 | — |
| Other enzymes granulates | 0.23 | 0.17 | 0.5 | 0.2 | 0.2 | 0.6 |
| Fluorescent Brightener(s) | 0.16 | 0.06 | 0.16 | 0.18 | 0.16 | 0.16 |
| Diethylenetriamine pentaacetic acid or Ethylene diamine tetraacetic acid | 0.6 | — | 0.6 | 0.25 | 0.6 | 0.6 |
| $MgSO_4$ | 1 | 1 | 1 | 0.5 | 1 | 1 |
| Bleach(es) and Bleach activator(s) | 6.88 | — | 6.12 | 2.09 | 1.17 | 4.66 |
| Sulfate/Moisture/perfume | Balance to 100% | Balance to 100% | Balance to 100% | Balance to 100% | Balance to 100% | Balance to 100% |

The following are granular detergent compositions produced in accordance with the invention suitable for laundering fabrics by front-loading washing machine.

| | Compositions | | | | | |
|---|---|---|---|---|---|---|
| | 7 (wt %) | 8 (wt %) | 9 (wt %) | 10 (wt %) | 11 (wt %) | 12 (wt %) |
| Linear alkylbenzenesulfonate | 8 | 7.1 | 7 | 6.5 | 7.5 | 7.5 |
| Other detersive surfactants | 2.95 | 5.74 | 4.18 | 6.18 | 4 | 4 |
| Zeolite | 7 | — | 7 | — | 2 | 2 |
| Citric Acid | 3 | 5 | 3 | 4 | 2.5 | 3 |
| Sodium Carbonate | 15 | 20 | 14 | 20 | 23 | 23 |
| Soil release agent | 0.75 | 0.72 | 0.71 | 0.72 | — | — |
| Acrylic Acid/Maleic Acid Copolymer | 1.1 | 3.7 | 1.0 | 3.7 | 2.6 | 3.8 |
| Highly soluble carboxymethyl cellulose particle[1] | 0.15 | 1.4 | 0.2 | 1.4 | 1 | 0.5 |
| Cellulase[2] | 0.2 | 0.15 | 0.2 | 0.3 | 0.15 | 0.15 |
| Other enzyme granulates | 0.65 | 0.75 | 0.7 | 0.27 | 0.47 | 0.48 |
| Bleach(es) and bleach activator(s) | 16.6 | 17.2 | 16.6 | 17.2 | 18.2 | 15.4 |
| Sulfate/Water & Miscellaneous | Balance to 100% | Balance to 100% | Balance to 100% | Balance to 100% | Balance to 100% | Balance to 100% |

In the exemplified compositions 1-12, the concentrations of the components are in weight percentage and the abbreviated component identifications have the following meanings.

LAS: Linear alkylbenzenesulfonate having an average aliphatic carbon chain length $C_{11}$-$C_{13}$, Highly soluble carboxymethyl cellulose particle[1]: Carboxymethyl cellulose granulate with 95 wt % of particles having a size of >75 μm and 4% of particles having a particle size of >1000 μm and comprising the following:

(a) 90% carboxymethyl cellulose having, degree of carboxymethyl substitution (DS) of 0.76 and a degree of blockiness (DB) of 0.81.

(b) 8% water (c) 1% sodium glycolate (d) 1% sodium chloride

Cellulase[2]: Celluclean® (15.6 mg active/g) supplied by Novozymes, Bagsvaerd, Denmark.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A solid laundry detergent composition comprising:

(a) detersive surfactant; and (b) from about 0.05 wt % to about 20 wt % carboxymethyl cellulose particle, wherein the carboxymethyl cellulose particle comprises:

(i) from about 70 wt % to about 98 wt % carboxymethyl cellulose having an average degree of carboxymethyl substitution of from 0.6 to 0.9;

(ii) from about 2 wt % to about 12 wt % water;

(iii) optionally from about 0 wt % to about 4 wt % sodium glycolate; and (iv) optionally from about 0 wt % to about 4 wt % sodium chloride;

wherein the carboxymethyl cellulose has a bimodal molecular weight distribution, wherein the first molecular weight modal has a peak in the range of from about 10,000 Da to below about 100,000 Da, and wherein the second molecular weight modal has a peak in the range of from about 100,000 Da to about 300,000 Da.

2. A composition according to claim 1, wherein the carboxymethyl cellulose particle has a particle size distribution such that:

(a) at least about 90 wt % of the particles have a particle size of above about 75 micrometers; and (b) less than about 15 wt % of particles have a particle size of above about 1000 micrometers.

3. A composition according to claim 1, wherein the carboxymethyl cellulose is a hydrophobically modified carboxymethyl cellulose, being further substituted with a hydrophobic moiety $R_c$ and/or $R_d$, and having a structure according to the following formula:

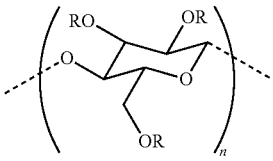

wherein R is

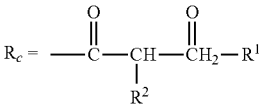

or

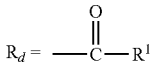

wherein in which $R^1$ and $R^2$ are alkyl or alkenyl chains having from about 5 to about 22 carbon atoms.

4. A composition according to claim 3, wherein the average degree of hydrophobic moiety substitution is in the range of from about 0.001 to about 0.2.

5. A composition according to claim 1, wherein the composition further comprises fabric hueing dye.

6. A composition according to claim 5, wherein the fabric hueing dye is cotton-substantive.

7. A composition according to claim 1, wherein the composition further comprises:

(a) from about 0 wt % to about 10 wt % zeolite builder; and (b) from about 0 wt % to about 10 wt % phosphate builder.

8. A composition according to claim 1, wherein the composition is in free-flowing particulate form.

9. A composition according to claim 1, wherein the carboxymethyl cellulose particle is in non-spray dried form.

10. A composition according to claim 1, wherein the carboxymethyl cellulose particle is in agglomerate form.

11. A composition according to claim 1, wherein the carboxymethyl cellulose has a degree of blockiness such that the sum of said average degree of carboxymethyl substitution and said degree of blockiness is at least about 1.00.

12. A composition according to claim 1, wherein the carboxymethyl cellulose has a degree of blockiness such that the sum of said degree of blockiness plus 2 times said average degree of carboxymethyl substitution minus said average degree of carboxymethyl substitution squared is at least about 1.20.

13. A composition according to claim 1, wherein the composition further comprises cellulase.

14. A composition according to claims 1, wherein the composition is in the form of a detergent sheet.

* * * * *